US006394278B1

(12) United States Patent
Reed

(10) Patent No.: US 6,394,278 B1
(45) Date of Patent: May 28, 2002

(54) WIRELESS SYSTEM AND METHOD FOR SORTING LETTERS, PARCELS AND OTHER ITEMS

(75) Inventor: Lance Patrick Reed, Duluth, GA (US)

(73) Assignee: Sort-It, Incorporated, Duluth, GA (US)

( * ) Notice: Subject to any disclaimer, the term of this patent is extended or adjusted under 35 U.S.C. 154(b) by 0 days.

(21) Appl. No.: 09/518,257

(22) Filed: Mar. 3, 2000

(51) Int. Cl.[7] ..... G07L 3/18

(52) U.S. Cl. ..... 209/44.4; 209/584; 209/702; 209/900

(58) Field of Search ..... 209/584, 702, 209/900, 44.4

(56) References Cited

U.S. PATENT DOCUMENTS

| | | | | |
|---|---|---|---|---|
| 3,587,856 A | | 6/1971 | Lemelson | |
| 4,307,296 A | | 12/1981 | Lazzarotti et al. | |
| 4,358,017 A | | 11/1982 | Erikson | |
| 4,503,977 A | | 3/1985 | Kohno et al. | |
| 4,578,759 A | | 3/1986 | Horii | |
| 4,632,252 A | | 12/1986 | Haruki et al. | |
| 4,641,753 A | | 2/1987 | Tamada | |
| 4,921,107 A | | 5/1990 | Hofer | |
| 5,664,110 A | | 9/1997 | Green et al. | |
| 5,677,834 A | | 10/1997 | Mooneyham | |
| 5,790,429 A | | 8/1998 | Baker et al. | |
| 5,978,798 A | | 11/1998 | Pozanaski et al. | |
| 5,881,890 A | * | 3/1999 | Wiley | 209/703 |
| 5,959,611 A | | 9/1999 | Smailagic et al. | |
| 5,982,904 A | * | 11/1999 | Eghtesadi et al. | 381/74 |
| 5,995,936 A | | 11/1999 | Brais et al. | |

* cited by examiner

*Primary Examiner*—Donald P. Walsh
*Assistant Examiner*—Daniel K Schlak
(74) *Attorney, Agent, or Firm*—Samuel W. Ntiros

(57) ABSTRACT

A system and method for assisting an operator in sorting mail includes a wireless headset equipped with a microphone, and a workstation that includes a processing unit, voice-recognition and voice-synthesis circuitry, and a database. In operation, addressee information spoken into the microphone is transmitted to the workstation where it is used to search the database. Destination information from a matching database record is then output to the operator on one or more of a display terminal, headset speakers, and heads-up display fixed to the headset. The convenience and enhanced capability provided by this system streamlines operator productivity and sorting volume. The emobdiments disclosed herein are primarily directed to a headset that is operated completely remotely from the processing unit, and also to a headset comprising a heads up display having means by which an operator can access the database.

29 Claims, 11 Drawing Sheets

| | | |
|---|---|---|
| 1. | SMITH, ADAM | ACCOUNTING X2121 |
| 2. | SMITH, BILL | ACCOUNTING J4244 |
| 3. | SMITH, JOHN | SALES X2345 |
| ⋮ | ⋮ | ⋮ |

FIG. 3

WIRELESS SYSTEM AND METHOD FOR SORTING LETTERS, PARCELS AND OTHER ITEMS

BACKGROUND OF THE INVENTION

1. Field of the Invention

This invention generally relates to sorting objects, and more particularly to a system and method which uses a voice-recognition unit to aid an operator in sorting letters, parcels, and other items of mail.

2. Description of the Related Art

Sorting systems have been used for decades by public and private organizations to route mail from one location to another. These systems generally take one of two approaches; they are either manual in nature or automated.

Manual sorting requires a worker to read name and address information on each piece of mail before placing it by hand into one of a number of bins. This approach has proven to be slow and inefficient and thus unsuitable for use in high-volume applications. Further, this kind of sorting tends to be inaccurate because it relies on the worker's memory and concentration skills. In order to sort, for example, a worker must have a fore knowledge of the mail routes and the bins corresponding to each route. And, if the worker forgets this information or is unfamiliar with a name or address, he must reference sorting tables, which further slows the process.

Automated sorting systems tend to be faster and more efficient than manual sorting techniques. This improved performance is achieved mainly through the use of a workstation situated between a feeder and sorting machine. The workstation typically includes a minimum of a processor, display terminal, database of addressee information, and keyboard. In operation, the feeder sends a letter to the workstation whereupon an addressee name on the letter is input into the system. The processor searches the database to locate a record matching the name, and the sorting machine then sorts the letter into a bin based on information in the matching record.

Improvements in automated sorting systems have principally focused on the input and output of information at the workstation. In early systems, information input was performed by an operator-controlled keyboard. See, for example, U.S. Pat. No. 4,578,759. Because keyboard entry tends to be slow, systems of this type are undesirable, especially for high-volume applications. Other systems use optical scanners to read the information on mail. See, for example, U.S. Pat. Nos. 4,358,017, 4,503,977, and 4,641,753 each of which discloses a system that reads computer-generated marks, e.g., bar codes. Another system, disclosed in U.S. Pat. No. 4,632,252, uses optical character recognition techniques to input names and addresses. While these systems sort letters at a potentially faster rate than keyboard-based systems, their use is limited to only sorting mail having computer-generated marks.

Still other systems are multiple-input systems, i.e., they accept input information from more than one device. U.S. Pat. Nos. 3,587,856, 4,307,293, and 4,921,107 disclose systems of this type which accept either keyboard or optical scanner input depending on the operator's choice or upon whether the letters have computer-generated codes.

Another type of multiple-input system allows an operator to input addressee information via a keyboard and voice-recognition unit. In this system, disclosed in U.S. Pat. No. 4,921,107 to Hofer, when letters are transported to a viewing position of a workstation, an operator speaks the addressee's name into a microphone. The voice-recognition unit translates the speech into digital signals identical to a keyboard input, and the workstation processor then controls an automatic sorting machine to sort the letter based on destination information in a matching database record.

Voice-driven systems like Hofer represent an improvement in the art because they allow addressee information to be input in a hands-free manner. Nevertheless, these systems have significant drawbacks. For example, the Hofer system sorts letters using a conventional sorting machine, for example, as described in U.S. Pat. No. 4,307,293 to Lazzarotti. Sorting machines of this type have a finite number of bins of limited capacity. Consequently, the volume they are able to handle is limited. Also, the voice-recognition unit of Hofer, made by Kurzweil Artificial Intelligence Corporation, is a primitive, hardware-based speech-recognition circuit which is costly by today's standards and often inaccurate.

In addition to the individual shortcomings discussed above, conventional automated sorting systems all have at least one additional drawback: They require an operator to be confined to a workstation. This is true even in optical scanning systems since the operator if required to make decisions, for example, when conflicts occur that can only be resolved through keyboard entry.

U.S. Pat. No. 5,677,834 to Mooneyham discloses a system which attempts to overcome this drawback by combining the manual and automated sorting approaches discussed above. The Mooneyham system does this by including a body-supported computer linked to a headset which functions as both an input and output unit. As shown in FIGS. 11A and 11B, computer 70 is adapted for attachment to a user's belt and includes a database for storing addressee information 71, a processor 72, a voice synthesis unit 73, a voice recognition unit 74, an input keypad 75, and a display 76. Headset 77 is equipped with a microphone 78 and speaker 79 and is connected to the portable computer by an electrical cord.

In operation, a user is presented with a number of mail items to be sorted. One by one, the user announces a street address into the headset microphone. The voice recognition unit recognizes the address and the processor searches the database for a matching record. If a match is found, the voice synthesis unit is activated to output destination information (e.g., a delivery route or bin number) to the user through the headset speakers.

The Mooneyham system has a number of drawbacks which make it undesirable from an efficiency standpoint. First, Mooneyham encumbers its user's mobility by requiring him to wear essentially the entire workstation on his body. This makes the system susceptible to physical damage and excessive wear, as the user may be expected to be very active within a confined area and thus the computer may knock into objects or be dropped on the floor during sorting.

Second, the information database must be limited in size in order to fit within the body-worn computer. As a result, the number of records stored in the database is small in comparison to conventional workstations. Also, the Mooneyham computer is a completely stand-alone system and therefore cannot access multiple databases at once or other databases through a network connection, all of which further limits functionality.

Third, when an error occurs or the voice recognition unit is unable to understand a microphone input, the user is required look at the portable computer display on his belt. This diverts the user's attention away from sorting, slowing the sorting process.

From the foregoing discussion, it is clear that a need exists for an improved, voice-driven system and method for assisting an operator in sorting items of mail without requiring the operator to be confined to a workstation, and more particularly a system and method which provides the operator with maximum mobility without sacrificing processing power, memory capacity, and system functionality.

SUMMARY OF THE INVENTION

It is a first object of the present invention to provide a system and method for assisting an operator in sorting items of mail that gives the operator virtually unlimited mobility, while at the same time maximizing system processing power, memory capacity, and functionality.

It is a second object of the present invention to achieve the first objective by providing a headset equipped with a microphone which allows the operator to wirelessly transmit addressee information to a workstation.

It is another object of the present invention to increase the range of the wireless headset so that it may be operated from virtually any distance, thereby allowing the workstation to be remotely located from the operator, if desired, and even on different rooms or floors.

It is another object of the present invention to provide a system and method of the aforementioned type which allows the operator to simultaneously access multiple databases at a time, and/or databases at other workstations or locations through a network connection.

It is another object of the present invention to incorporate a speaker into the headset which outputs destination information to the operator in a synthesized voice, thereby eliminating the need to read this information from a workstation display and giving the operator even greater mobility during sorting.

It is another object of the present invention to incorporate a heads-up display into the headset which displays destination information to the operator, as well as a series of interactive screens which allow the operator to re-configure or otherwise control the system through voice-drive commands, further freeing the user from the confines of the workstation.

It is another object of the present invention to provide a system and method which performs voice-recognition with improved accuracy compared with conventional mail sorting systems equipped with voice-recognition units.

It is another object of the present invention to increase the functionality of the workstation of the present invention over conventional workstations by providing a pronunciation engine, a statistical tracking feature, a report generation feature, a quick-search feature, as well as other functions which improve the management of sorting operations, all of which are either selectable or controllable by the headset of the present invention.

It is another object of the present invention to automatically print a label bearing destination, addressee, and/or other information when a database search has found a matching record, which label further streamlines the sorting process by giving personnel a guide as to the distribution of mail items.

These and other objectives of the invention are achieved by providing a system and method which uses a wireless headset adapted to communicate with a fully functioning workstation. In a first embodiment, the headset is equipped with a microphone which converts addressee information and commands into speech signals which are then transmitted to a voice recognition unit in the workstation. The voice recognition unit is preferably software-driven, speaker-independent, and supports multiple operators using adaptively trained models. Once recognized, addressee information is used by a processing unit to search a database of records. Destination information in a matching database record is then output to a display terminal where the operator is located and sorting is performed accordingly.

In a second embodiment, a speaker and receiver are included in the headset to sustain duplex communications, and a voice synthesis unit is connected to the processing unit of the workstation. When a database search is performed, the voice synthesis unit converts destination information in a matching record into speech signals that are transmitted to the headset. The speaker in the headset then audibly communicate the information to the user.

In a third embodiment, a heads-up display and receiver are included in the headset. When a database search is performed, the destination information in a matching record is transmitted to the heads-up display, which is then viewed by the operator for sorting.

The second and third embodiments are especially advantageous since the headset speakers and heads-up display each allow the user not only to sort mail items without interruption, but also to select between addressees when more than one matching record is found in the search. Also, through the heads-up display, the operator can access interactive screens for re-configuring the system or performing any number of optional system functions without having to return to the workstation site. This is especially advantageous when the workstation is remotely located from the mail sorting area.

Optional system functions include volume and operator productivity report generation, statistical analysis and graphing, speak or spell options, network connection capability, and database import capability. The system also includes a pronunciation unit which assists an operator in correctly pronouncing addressee information, and a printer is provided for printing labels containing destination or other information. If desired, the printer may be controlled to automatically print a label when database results are returned to the headset.

BRIEF DESCRIPTION OF THE DRAWINGS

FIG. 3 is an exemplary display screen listing search results produced from a database search performed in accordance with the present invention;

DESCRIPTION OF THE PREFERRED EMBODIMENTS

The present invention is a system and method for assisting personnel in sorting items of mail in a time-efficient manner while giving him maximum mobility. This is accomplished through a wearable input device which a worker uses to obtain routing and other destination information from a database. The information is then conveyed to the worker through at least one of three output devices, all in a manner which streamlines high-volume sorting both in terms of costs and worker productivity.

Figure 1:
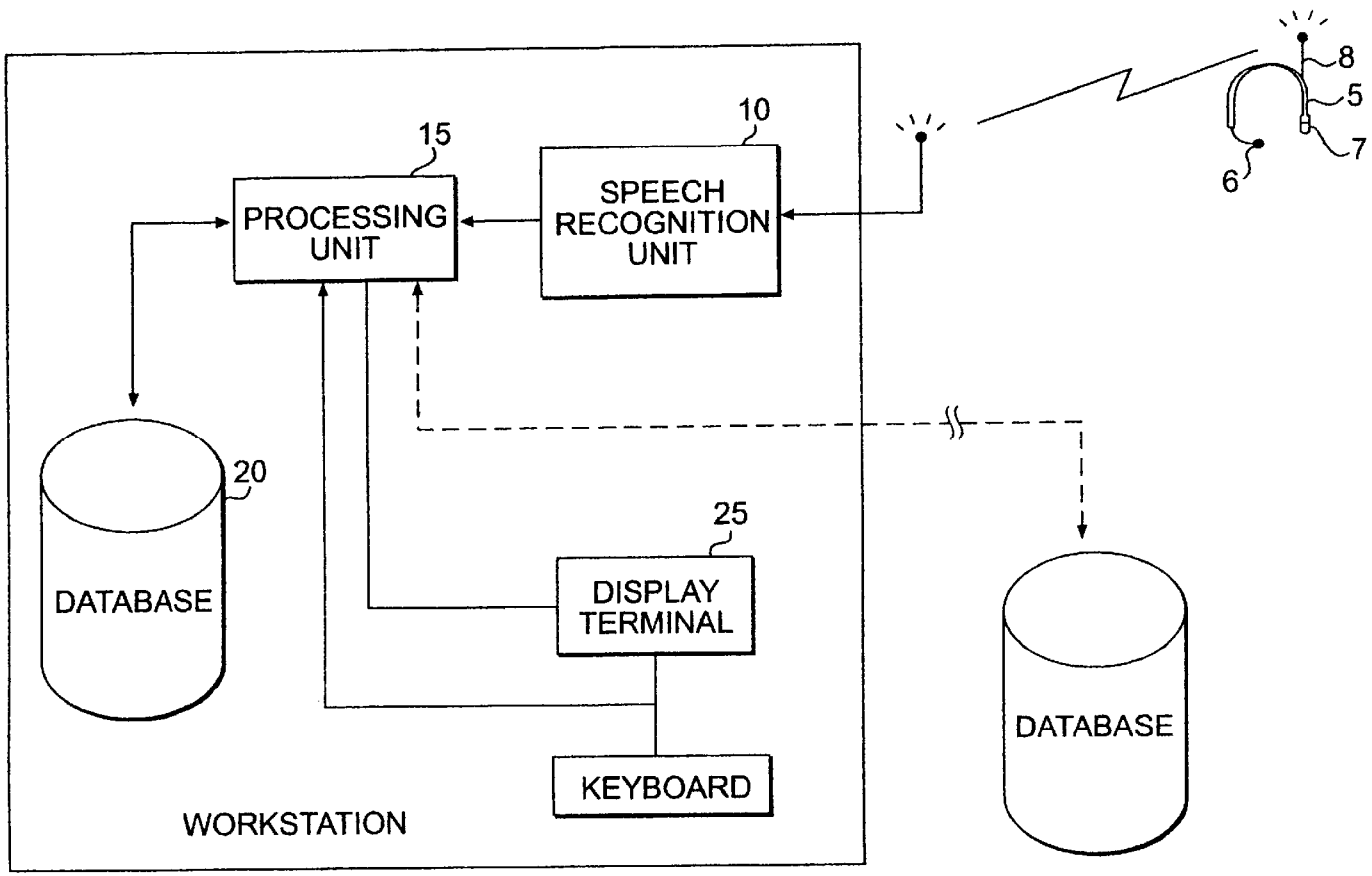
FIG. 1 is a diagram showing a first embodiment of the system of the present invention.

Referring to FIG. 1, a first embodiment of the system of the present invention includes an input device in the form of a headset 5, and a workstation which includes a speech recognition unit 10, a processing unit 15, a database 20, and a display terminal 25. Headset 5 is used by an operator who may be a mail room manager or other person responsible for manually sorting mail, for example, into a plurality of bins, each marked for distribution to a particular destination or employee. The workstation may be closely or remotely located from the operator, but if remotely located display terminal 25 (or a like terminal connected to the processing unit) must be located within reading distance at the operator site, for reasons that will become apparent below.

The headset is equipped with a microphone 6 for converting verbal statements into speech signals. To increase the mobility of an operator during sorting, headset 5 is preferably a wireless headset which transmits signals to the speech recognition unit over a predetermined band of RF frequencies via a transmitter 7 and antenna 8. The range of the transmitter may be adjusted to meet the requirements of each mail room, or even to penetrate through walls or multiple floors of the building. A common range of transmission is 250 feet, but those skilled in the art can appreciate that virtually any range is possible provided a battery of suitable power is connected to the headset.

The headset may include a number of optional features. For example, the transmitter battery housed in the headset may be rechargeable, and both the headset and microphone may be adjustable to suit the physical characteristics of each wearer. Furthermore, the microphone may be a noise-cancellation microphone. Instead of a wireless link, headset 5 may be connected to the workstation by a long signal wire, if desired.

Speech recognition unit 10 receives speech signals from the headset microphone through an antenna of the workstation. Preferably, speech recognition unit 10 is a software-based application which is speaker-independent, text-independent, or both. Such systems are desirable because they can be "trained" to recognize the voices, vocabularies, and speaking styles of different operators, thereby enhancing system versatility. This may be performed, for example, by having each operator read a short story, e.g., 3 to 5 minutes in length, into the microphone. The speech recognition unit will then formulate speech models corresponding to each operator's voice, thereby making voice recognition 98 to 100% accurate. Software-based units are also preferable because they can be easily modified to include new operators. Speech recognition software of this type includes Microsoft Speech Recognition®. Those skilled in the art can appreciate, however, that any type of speech recognition unit may be used in accordance with the present invention, including those that are hardware-based.

The processing unit 15 may be designed to operate on a high-end PC platform running specialized software for implementing the method of the present invention. Unit 15, for example, searches database 20 based on information recognized by the speech recognition unit, processes operator instructions based on wireless and keyboard input, and manages the output of the database search. Processing unit 15 also tracks operator performance, generates reports, and controls label printing, as well as other functions described in greater detail below.

Database 20 stores records corresponding to addressee information that may be expected to appear on the mail items to be sorted. If the system of the invention is employed in a corporate mail room, the addressee information may include employee names and/or the corporate departments where they work. If in a post office, addressee information may include the names and addresses of residents along specified delivery routes. The database records also include destination information such as an internal mail drop or zip address, the specific number of a bin in a mail room, or any other form of data identifying the location of the addressee. In order to distinguish between addressee, especially in the case of same-name employees, additional information may be included in each record for display. Database 20 may be any conventional type, e.g., Microsoft Access, and may be connected to processing unit 15 either directly or through a communications network which, for example, may be a LAN, WAN, or the internet. (In FIG. 1, the dotted line signifies a network connection to an external database).

Figure 2:
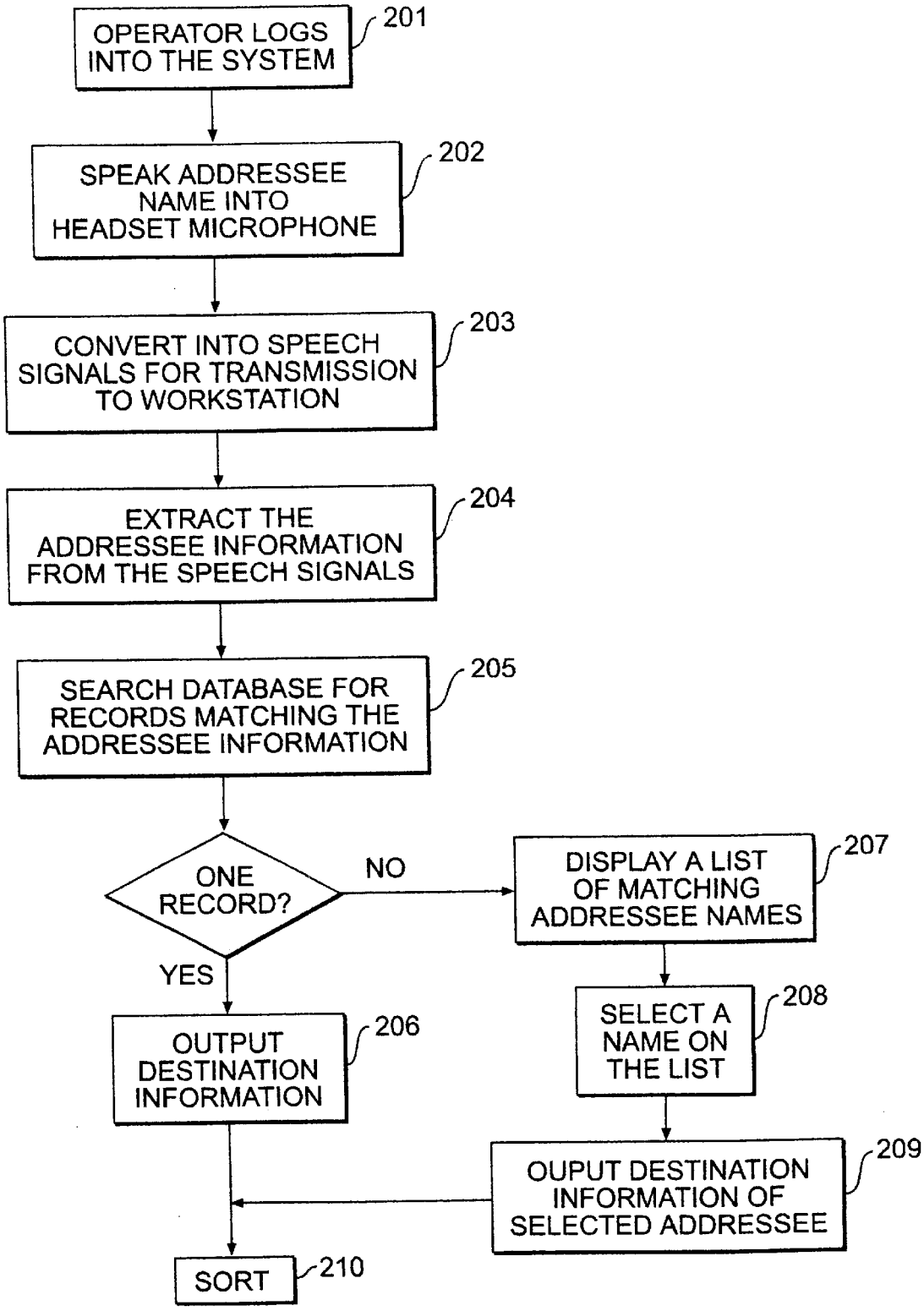
FIG. 2 is a flow diagram showing steps included in a first embodiment of the system of the present invention.

Operation of the first embodiment of the present invention is described with reference to the flow diagram of FIG. 2. First, an operator logs into the system, for example, by typing his name into the workstation computer. Once logged-in, the system automatically loads the speech recognition model corresponding to the operator into the speech recognition unit. The user then places the headset on his head and goes to a mail room where mail items are kept for sorting. (Block 201). The mail room may either include display terminal 25 at a position readable by the operator, or if the workstation is located in another room or floor a second terminal connected to the workstation may be used in the mail room.

To begin sorting, the operator speaks addressee information (e.g., the addressee name) on a each mail item into the microphone of the headset. (Block 202). The microphone converts the verbal input into speech signals which are then transmitted to the workstation. (Block 203). Once received, the speech recognition unit extracts the addressee information from the speech signals. (Block 204). This may be performed, for example, in the following way. First, if software-driven, the speech recognition unit converts the speech signals into PCM digital modulation. The speech is then broken into phonemes and context-free grammar is applied so that the speech recognition software knows what phonemes to expect. The software determines which phonemes are spoken and then converts the phonemes into words. The words, which correspond to the addressee information, are then forwarded to the processing unit, which searches the database to find one or more records matching the addressee information. (Block 205).

If only one matching record is found, the processing unit outputs destination information in the record to the display terminal where the operator can read it. (Block 206). This destination information may be in a variety of forms including an internal mail drop or zip number, a specific bin number, an address, etc. If desired, other information from the record may be output along with the destination information. The operator then places the mail item into the appropriate bin.

If more than one matching record is found, information further identifying the matching addressees is output on the display terminal. (Block 207). For example, as shown in FIG. 3, a list of addressees with the same last name may be displayed along with their first names, an employee number, a department number, job title, or other information that would assist the operator in distinguishing among the matching addressees. In the event that the list of matching addressees is too long to display on one screen, the operator can scroll through the list by speaking commands into the microphone, which are then interpreted by the speech recognition unit and implemented by the processing unit. These commands may be in any form used to control a display, such as "page down," "page up," "page end," or "page home" to name a few. To aid the operator in making these commands, a scroll bar may be displayed within the screen.

Figure 4:
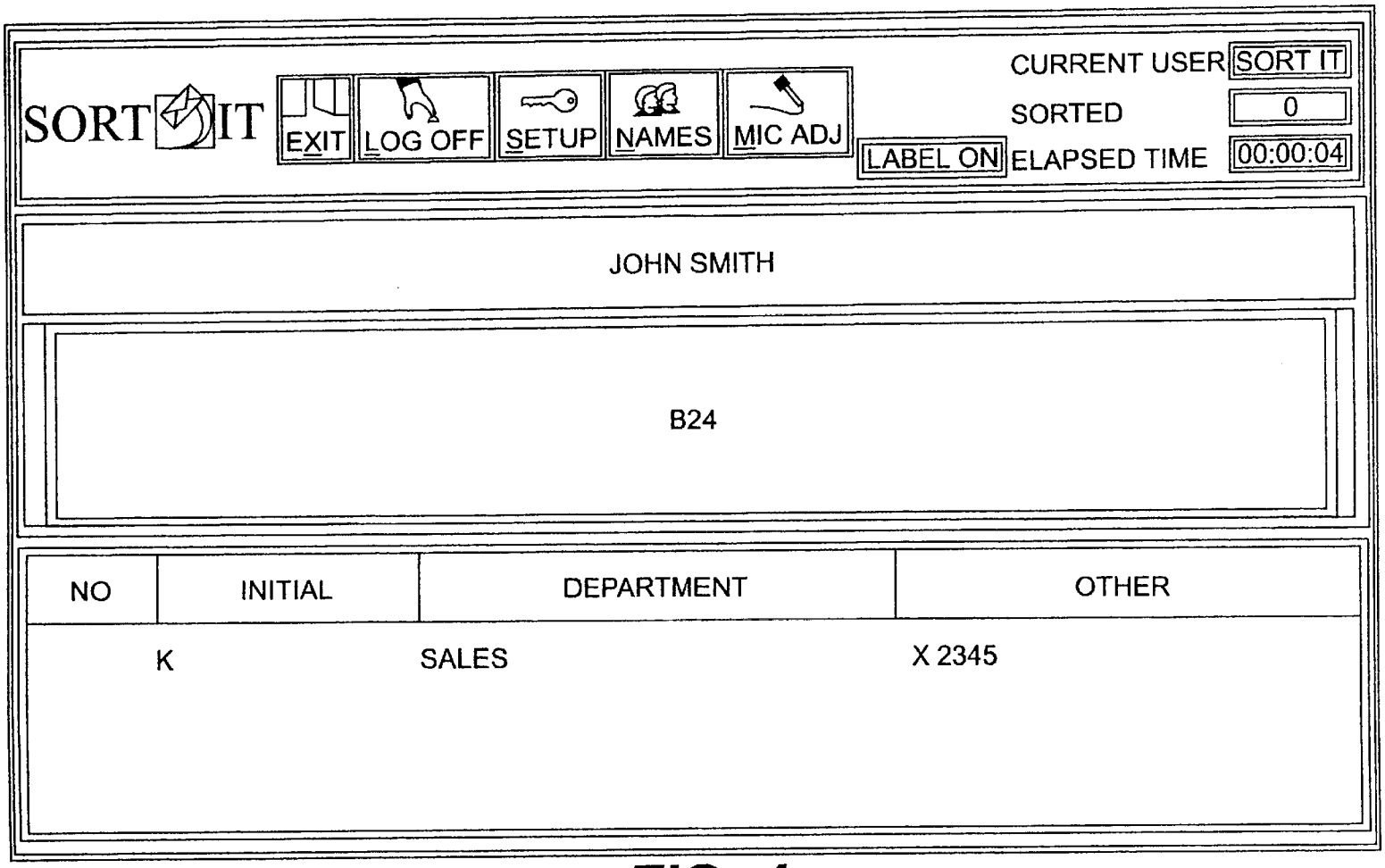
FIG. 4 is an exemplary display screen showing destination information output on a display terminal in accordance with the present invention.

To select an addressee, the operator speaks a number adjacent to the addressee name in the list into the microphone, for example, by saying the word "Number" followed by the number displayed adjacent the selected addressee's name. (Block 208). The processing unit the outputs the destination information of the selected addressee to the display (Block 209), and the operator sorts the mail item in accordance with the destination information (Block 210). FIG. 4 shows an exemplary display screen for conveying destination information in the form of a bin number "B24" corresponding to corporate employee "John Smith," along with additional identification information in the form of initial "K," the designation of "Sales" department, and number "X 2345" which may be a mail stop or internal zip code or even an employee number.

In any of the foregoing steps, if the speech recognition unit is not able to recognize input speech signals, the user may type the addressee information into the system directly. Thus, it may be desirable to have the workstation in the vicinity of the operator's work area, or at least a keyboard which is connected to the workstation. If the name entered is not found in the system database, the processing unit may output a message such as "Name Not Found" on the display.

Figure 5:
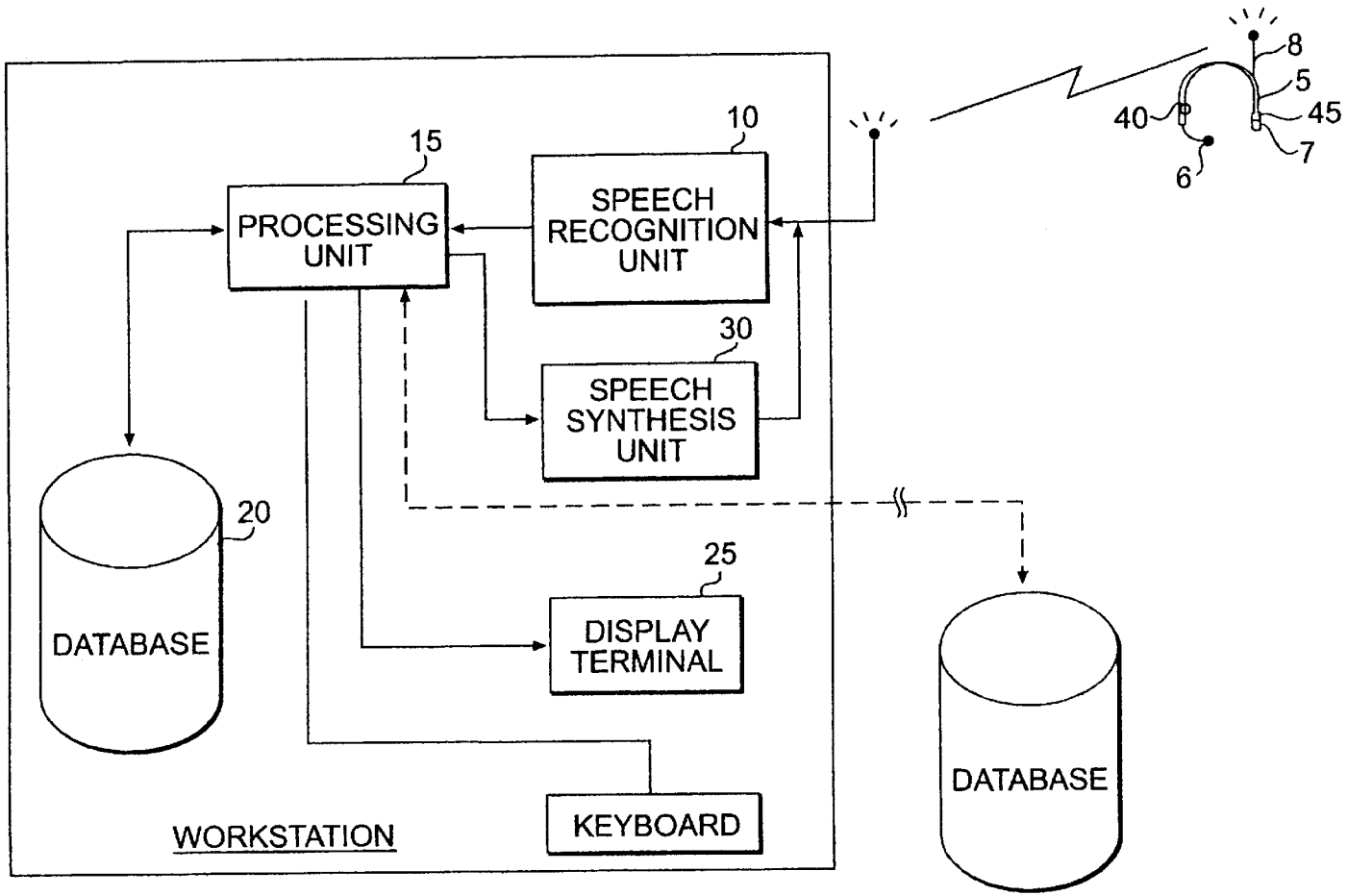
FIG. 5 is a diagram showing a second embodiment of the system of the present invention.

Referring to FIG. 5, a second embodiment of the system of the present invention has all the features of the first embodiment, with the following exceptions. First, the workstation is equipped with a speech synthesis unit 30 that is connected to processing unit 15 at one end and the antenna at the other end. Speech synthesis unit 30 may be any type conventionally known for generating an artificial voice for communicating information.

Second, headset 5 is equipped with at least one speaker 40 connected to a receiver 45 powered, for example, by the transmitter battery. Through these features, the headset of the present invention performs duplex (two-way) communications with the workstation. This is streamlines the productivity of the operator as it eliminates the need to look at a display screen during sorting, at least in the situation where only one addressee is found during the database search.

Figure 6:
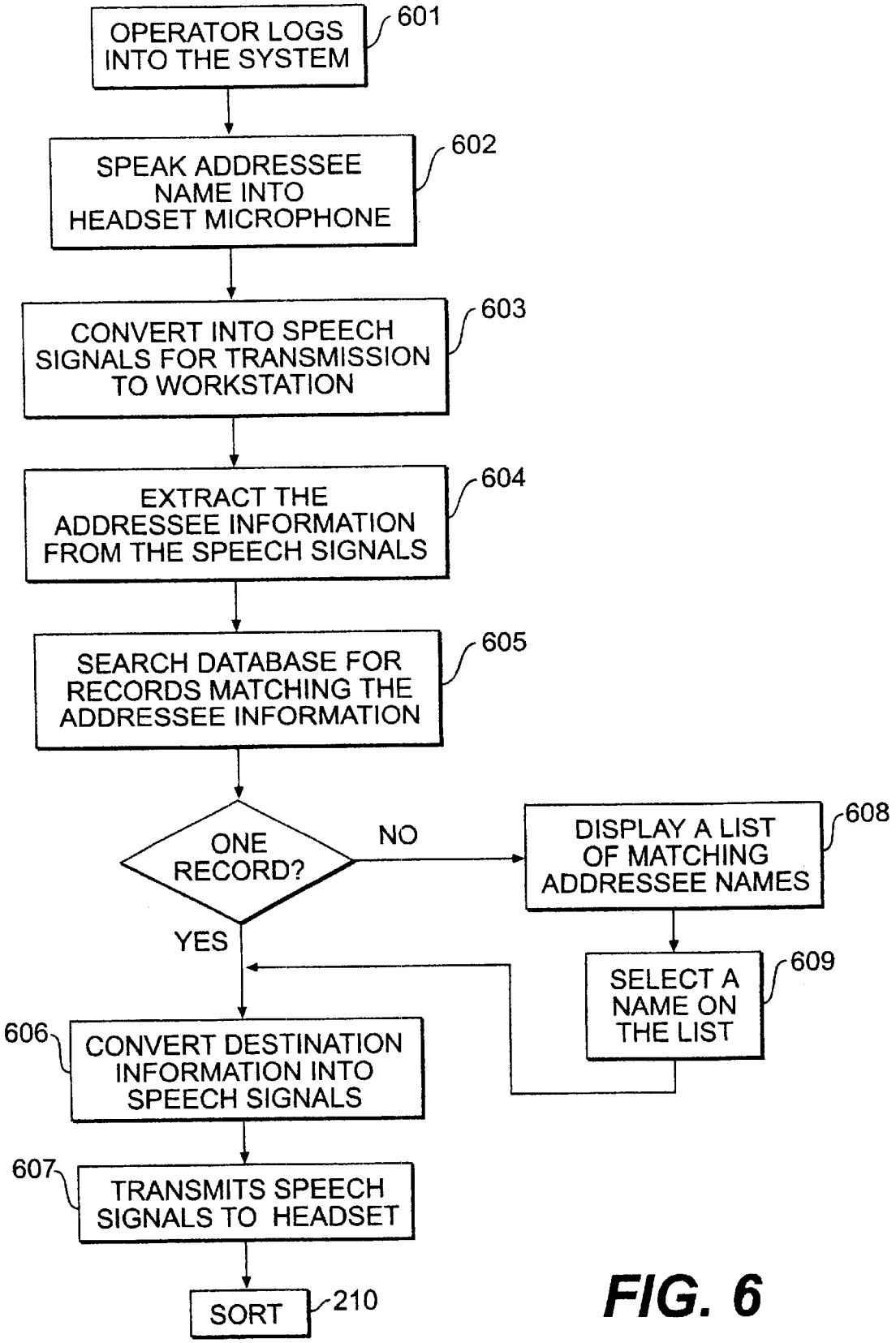
FIG. 6 is a flow diagram showing steps included in a second embodiment of the method of the present invention.

Operation of the second embodiment is similar to the first embodiment except as follows. Referring to FIG. 6, after logging in, an operator places the headset on his head and goes to a mail room. (Block 601). To begin sorting, the operator speaks addressee information printed on each mail item into the headset microphone. (Block 602). The microphone converts the verbal input into speech signals which are then transmitted to the receiver at the workstation. (Block 603). The speech recognition unit recognizes the addressee information from the speech signals and forwards this information to the processing unit. (Block 604). The processing unit searches the database to find one or more records that match the addressee information. (Block 605).

If only one matching record is found, the processing unit activates the speech synthesis unit, which converts destination information (e.g., bin number, internal mail stop, etc.) in the matching record into speech signals. (Block 606). A transmitter connected to the speech synthesis circuit then transmits the speech signals to the receiver of the headset, where the destination information is then audibly communicated to the operator through the speakers in a synthesized voice. (Block 607).

If more than one matching record is found, the processing unit may cause an alarm tone to be transmitted to the headset to inform the operator that more than one match was found and that a choice of addressees must now be made. In this case, like in the first embodiment, a list of the matching addressees is displayed along with further identifying information. (Block 608). The operator views the list and makes a selection, for example, by speaking the corresponding number of the addressee into the microphone. (Block 609). The speech signals corresponding to the number are transmitted back to the work station where they are recognized by the speech recognition unit and input into the processing unit. The processing unit then conveys destination information in the selected record to the speech synthesis circuit, which converts this information into speech signals (block 606) for transmission to the headset (Block 607). The destination information (e.g., a bin number) is then output to the operator through the headset speaker and the mail item is sorted accordingly. As those skilled in the art can appreciate, selection in accordance with any of the embodiments described herein may be made in other ways, such as speaking or typing an addressee's name, employee number, or the like.

Figure 7:
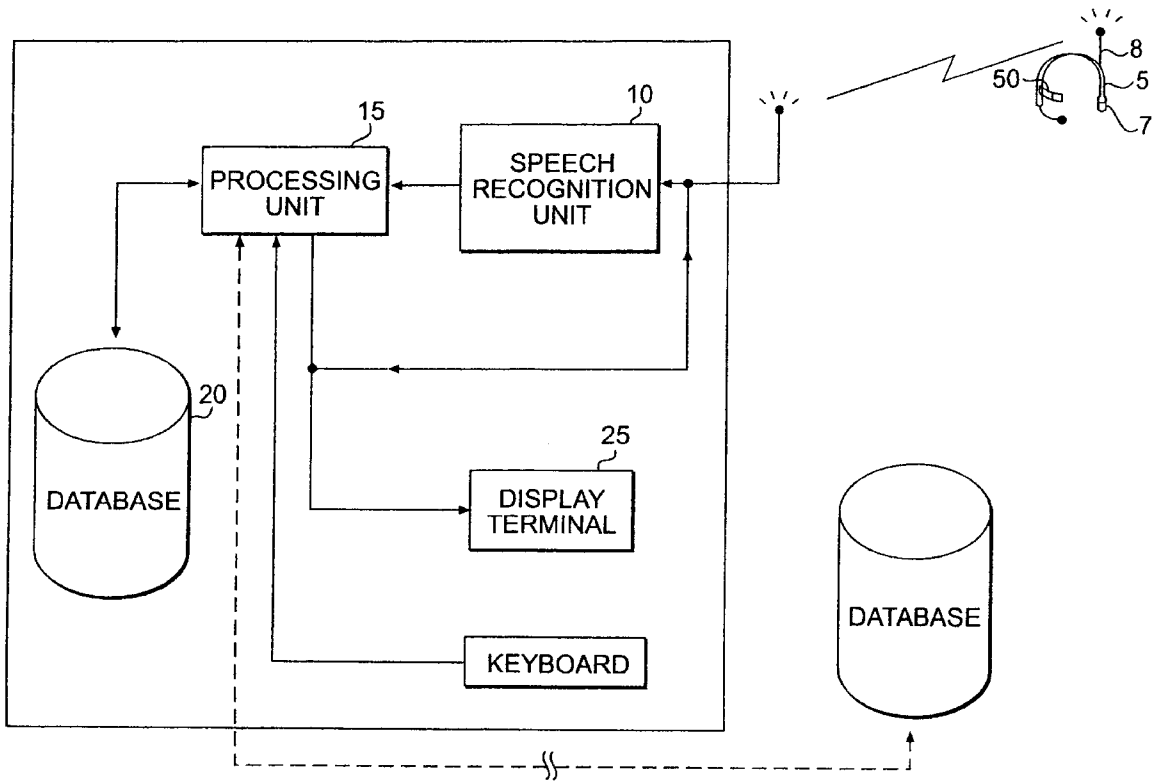
FIG. 7 is a diagram showing a third embodiment of the system of the present invention.

Referring to FIG. 7, a third embodiment of the system of the present invention is similar to the second embodiment, except that instead of speakers a heads-up display 50 is integrated onto the headset. The heads-up display may be any one of a number of conventional wearable displays which may or may not be wireless, such as disclosed in U.S. Pat. Nos. 5,959,611 and 6,005,536. To communicate with the heads-up display, the workstation of the invention includes a transmitter connected to the processing unit.

Figure 8:
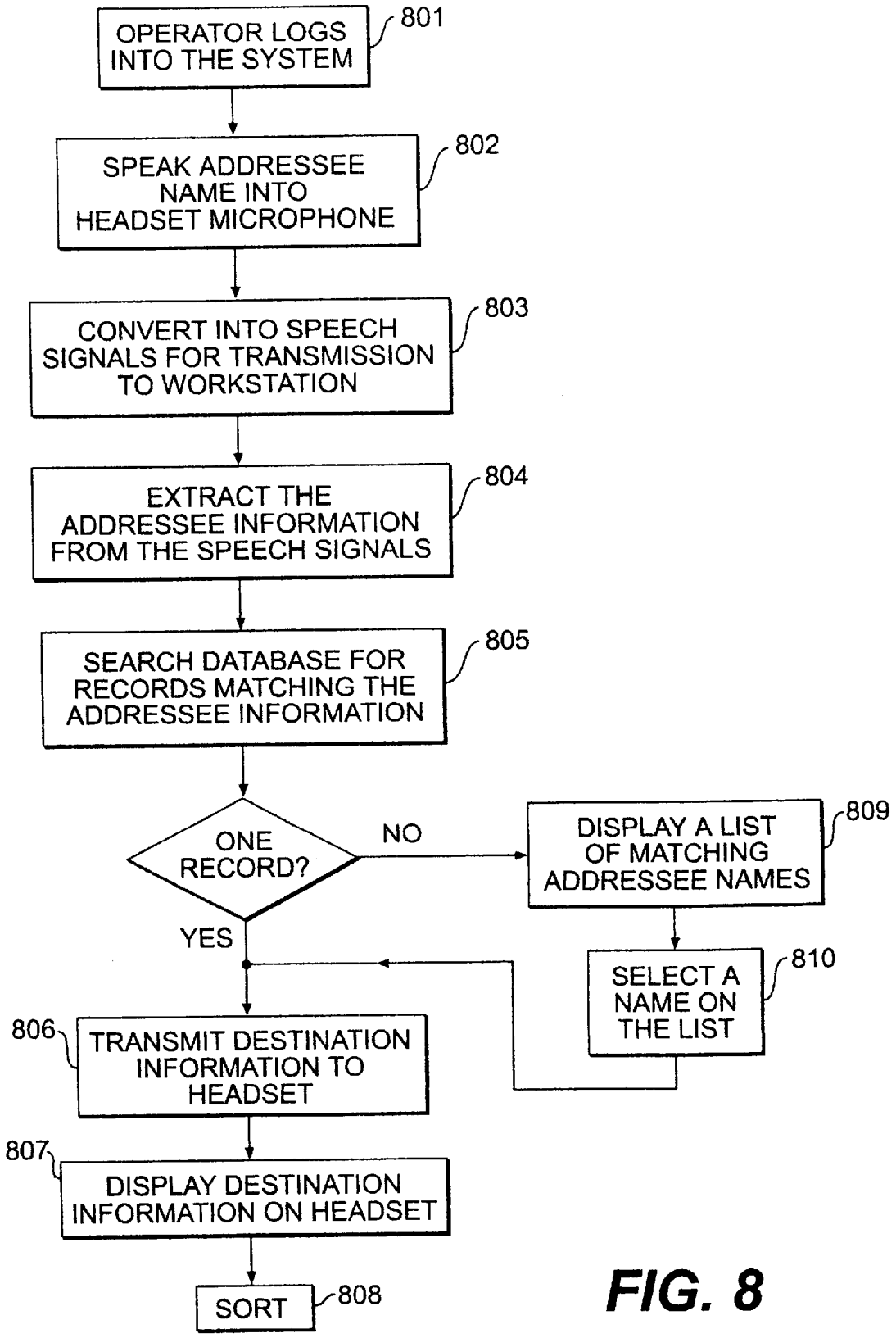
FIG. 8 is a flow diagram showing steps included in a third embodiment of the method of the present invention.

Operation of the third embodiment is similar to the second embodiment except for operation of the heads-up display. Referring to FIG. 8, after log-in, the operator speaks addressee information printed on each mail item into the headset microphone. (Block 802). The microphone converts the verbal input into speech signals which are then transmitted to the receiver at the workstation. (Block 803). The speech recognition unit recognizes the addressee information from the speech signals and forwards it to the processing unit. (Block 804). The processing unit then searches the database to find one or more records that match the addressee information (Block 805).

If only one matching record is found, the transmitter transmits the same display information (e.g., destination information) it sends to display terminal 25 to the receiver in the headset. (Block 806). The heads-up display then displays the destination information to the operator (Block 807) and the mail piece is sorted accordingly. (Block 808).

If more than one matching record is found, the same steps as in the second embodiment are performed, except that the operator does not have to look at the workstation monitor to make the addressee selection. Instead, he merely looks at the heads-up display and selects an addressee from the list by speaking a number corresponding to the addressee, or other information, into the headset microphone, all without stopping work. (Blocks 809 and 810). The heads-up display thus streamlines the mail sorting process.

Figure 9:
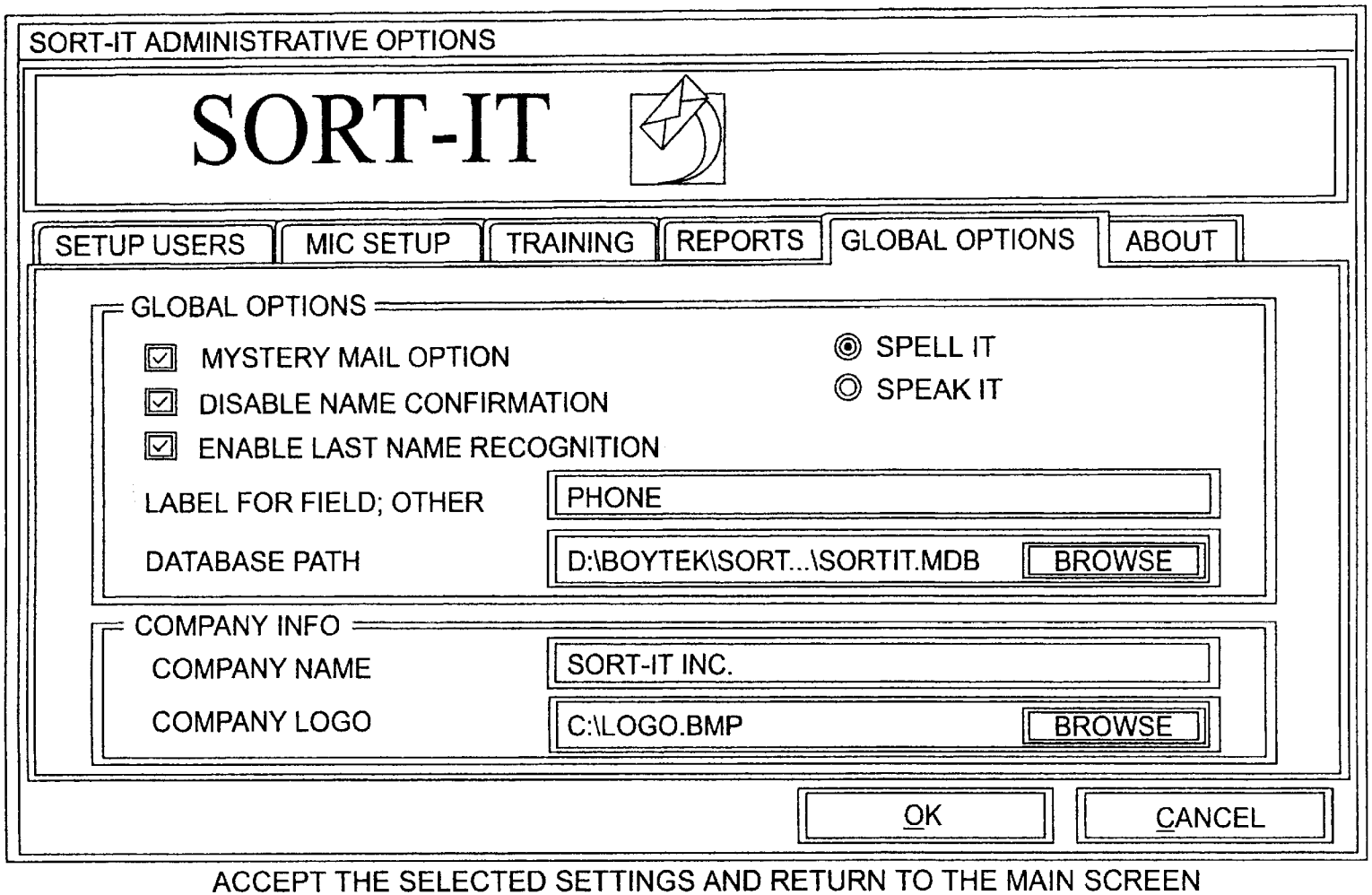
FIG. 9 is an exemplary display screen showing optional features of the present invention.
Figure 10:
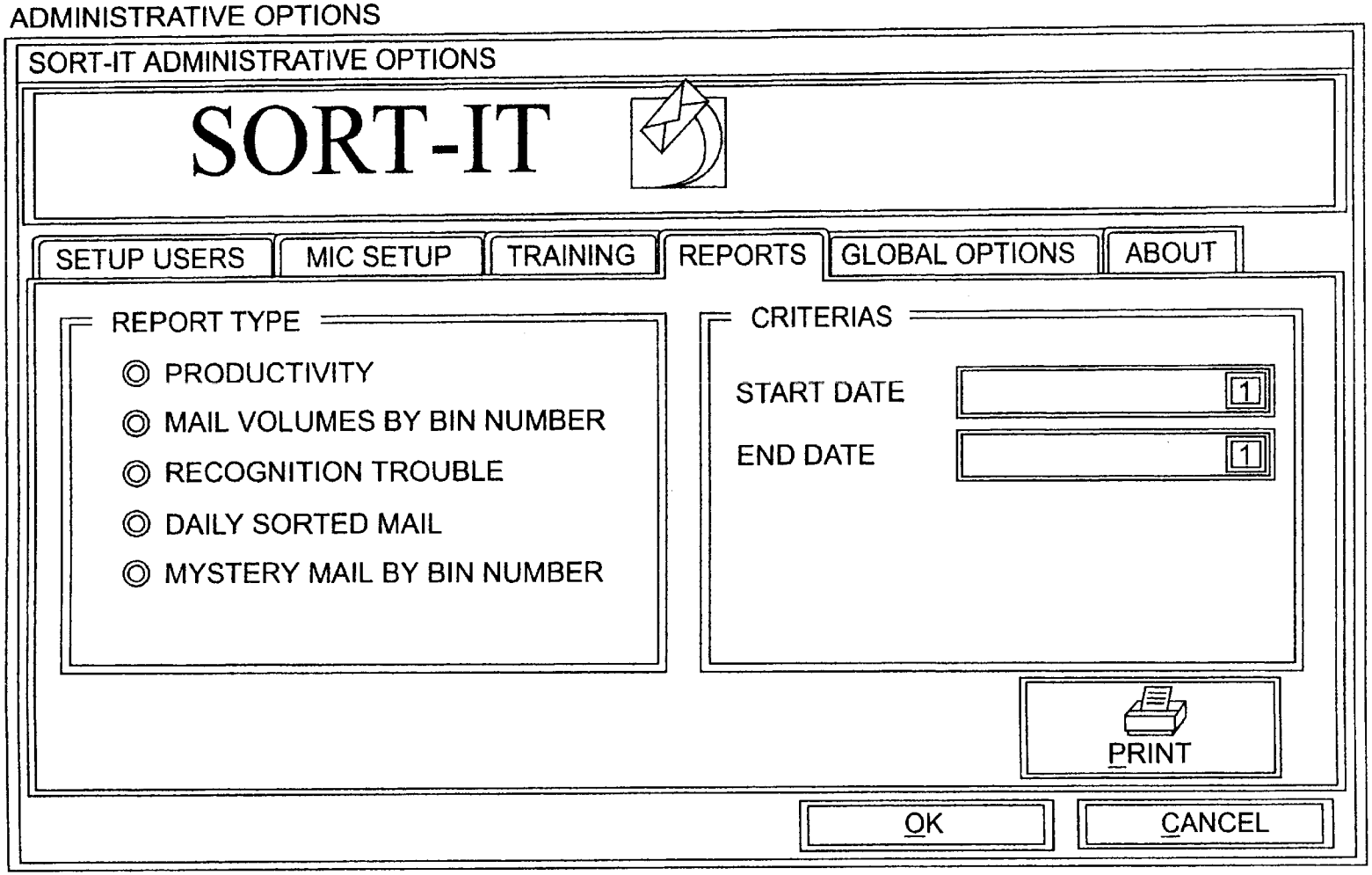
FIG. 10 is an exemplary display screen showing additional optional features of the present invention.
Figure 11B:
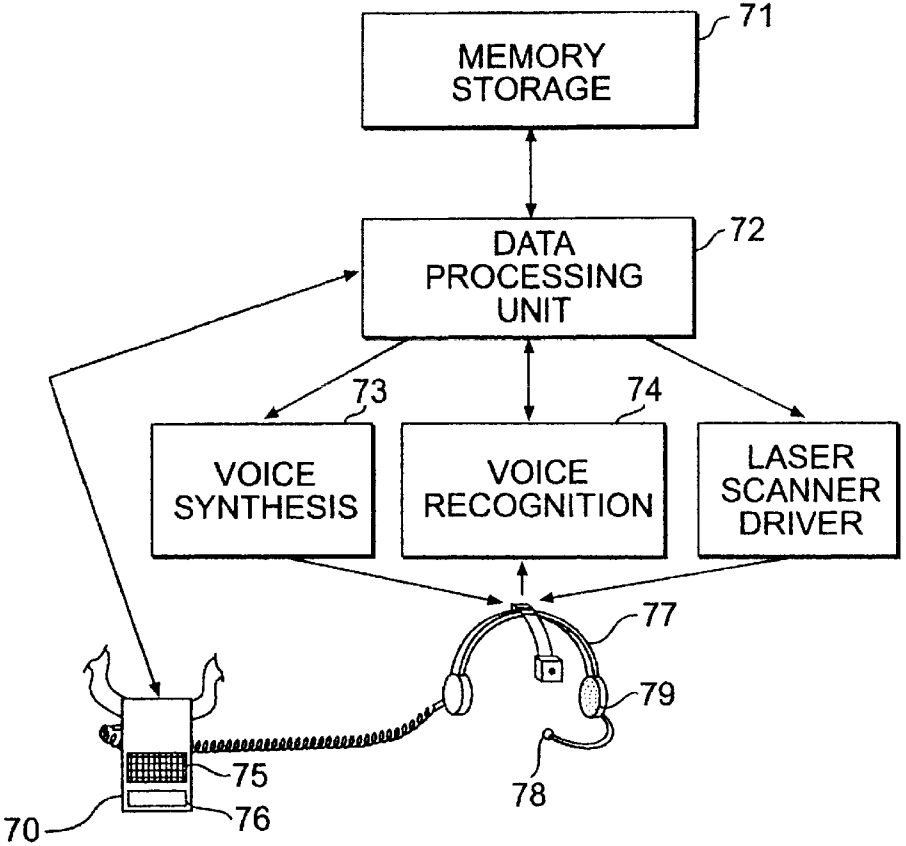
FIGS. 11A and 11B are diagrams showing a conventional mail sorting system.
Figure 11A:
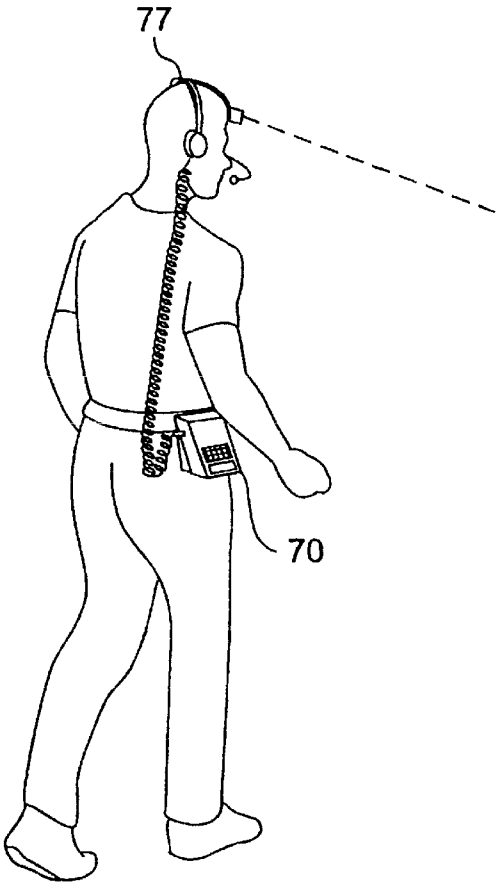

All the embodiments of the present invention described herein may include one or more of the following optional features, which may be implemented as software functions performed by the processing unit. If desired, these functions may be user-selectable through display screens similar to the ones shown in FIGS. 9 and 10.

Multi-Operator Support. Through this function, the system supports multiple operator log-ons, each of which organizes an operator's setup information, voice training, and speech characteristics. This improves speech recognition accuracy because each operator has his own independent speech library. The log-on may be performed with a secure password. The system may also be configured to support multiple operators simultaneously stationed, for example, at different sorting locations or positions.

Operator Statistics. Through this function, a variety of statistics may be tracked. These statistics may specifically include tracking current operators' names, the number of mail items sorted by each operator, the time taken to sort mail during any given session, as well as other statistics relating to sorting volume and operator performance. This information may then be used to generate reports in accordance with the reporting function described below.

Mute. This function mute sounds generated by the system, including those generated at the workstation.

Assistant. This function may be used when an operator has difficulty pronouncing, for example, an addressee name on a mail item to be sorted, or when the system returns a message indicating that the database does not contain any records corresponding to the addressee name. To use this function, the operator types in the addressee name using the workstation keyboard. The processing unit searches the database for matching records, and if a match is found the speech synthesis unit outputs speech signals either to the headset or another speaker at the workstation informing the operator of the correct pronunciation, or at least the pronunciation which the speech recognition unit is tuned to recognize.

Ouick Search. This function is accessed on a computer screen at the display terminal. In using this screen, an operator types in an addressee name to determine whether it exists in the database. Doing so shrinks the searchable range of names to the first letters typed, thereby allowing quick name searches to be performed.

Employee Database Screen. This screen allows an operator to add, delete, edit, speak, spell, or search information in the database. It also allows for report generation.

Administrator. This function allows the password for an operator to be added, removed, or changed.

Microphone Adjustment. This function allows the operator to configure the system to be compatible with a specific type of microphone, as well as make adjustments.

Training. This function allows the speech recognition unit to develop and train models corresponding to system operators.

Mystery Mail. This function instructs a printer to print a label containing information such as the name of the operator, the bin number into which a mail item is to be sorted, corporate department, or information alerting the addressee of important delivery information. If desired, this function can be automatically activated upon the user speaking an addressee name into his headset microphone.

Location Label. This function instructs the printer to generate a location label that displays the bin number only.

Name Configuration. This function allows an operator to speak a command into the headset microphone to confirm that the name displayed by the system after a database search is correct. After confirmation, the bin number is either displayed or output on the headset speakers.

Name Recognition Options. This function allows a user to configure the system to perform database searches on a first name basis only, a last name basis only, or on a first and last name basis.

Speak-It/Spell-It Option. This function configures the speech synthesis unit to generate signals that will cause the destination information (e.g., bin number) to be audibly pronounced by either speaking it or spelling it. This function can be set globally or individually based on the preference of the operator.

Label Field "Other". This function configures the system to display information other than destination information corresponding to the database record selected by an operator.

Network Option. This function allows multiple systems to use the same database. With this function, an operator can browse the network (e.g., LAN, WAN, internet)to locate the main names database.

Customer Information. This function customizes the system with the name and logo of a company who purchased the system.

Import Utility. This function allows data to be manually imported into the system workstation. The function supports comma, tab, space, quotes, forward slash, colon and delimits files. It also can import Microsoft Excel® and Microsoft Access® files.

Backaround Import. This function instructs the system to automatically connect to a network location at a specific date and time and import a new database in, for example, ASCII, Microsoft Excel®, and/or Microsoft Access® formats without operator intervention.

Pronunciation Feature. This function modifies the pronunciation of a word so that the speech recognition unit accurately recognizes the name when it is spoken.

Reporting. This function generates a variety of reports that can be exported in various forms. These reports are based on statistical information which, for example, track operator productivity and volumes for the purpose of staff planning. Examples include reports on operator productivity; mail volume by name, bin number, and department; Assistant reports; Mystery Mail by name, bin number, and department; name; search criteria, date range; bin number; and date range. (See FIG. 7).

Graphical Reporting. This function generates graphical reports based on, for example, productivity statistics for each operator, daily volume (e.g., graphs daily volume versus day), search criteria, and date range.

In addition to the above features, the workstation display terminal may be configured to display the following screen features:

User statistics.

Status box that displays messages from the system.

Engine status box that displays speech engine related messages.

Displays grid with the user information (department, Middle Initial, Other) and also use for duplicate names.

Level Bars that reflect the voice volume input from the user.

Easy and ergonomic interface with eye pleasing color design for extended viewing.

The workstation display terminal may also display any one of the following hot keys and button keys to effect various processor functions:

| | | |
|---|---|---|
| F5 | | Change administrator password |
| F10 | | Quick search of mail recipients |
| F1 | | Help |
| Space Bar | | Mute Sort-It via software |
| Enter | | Unmute Sort-It via software |
| Ctrl + Alt + Shift + F9 | | Maximum speech input |
| Ctrl + Alt + Shift + F11 | | Phoneme setup |
| Ctrl + Alt + Shift + F12 | | Adjustments of accuracy recognition & rejections |
| Exit button | Alt-X | Exits the Sort-It System to windows and asks for confirmation |
| Log off button | Alt-L | Log off the current session displaying current performance per session and returns to the logon screen |
| Mic Adj | Alt-M | Allows user to adjust the volume of the microphone input to system and the volume for the speaker or headset |
| Names | Alt-N | Allows the administrator to maintain the Sort-it Database |
| Setup | Alt-S | Allows to the administrator to access to the system options, reports, configuration |
| Label ON/OFF | | Toggle switch to print labels for each mail recipient searched (Optional feature) |

Other modifications and variations to the invention will be apparent to those skilled in the art from the foregoing disclosure. Thus, while only certain embodiments of the invention have been specifically described herein, it will be apparent that numerous modifications may be made thereto without departing from the spirit and scope of the invention.

For example, the system and method of the present invention may be used by operators in sorting items directly into sorting bins, or may be used in conjunction with a conveyor system or other transport device. In the latter situation, an operator inputs addressee information into the headset microphone and receives back destination information through the headset speakers. At the same time, a printer 200 prints out a label containing the destination information which the operator sticks on the item. The item is then placed on a conveyor to be distributed by other personnel. As one skilled in the art can appreciate, a variety of sorting scenarios are possible with the present invention, and thus the particular applications described herein are merely illustrative.

Also, while the invention is well-suited to sorting letters, parcels, packages, and other items of mail in a government or corporate mail room, those skilled in the art can appreciate that the invention may be adapted to sort other items including books searched by author, title, catalog number, etc; merchandise searched by inventory number, brand, etc; and luggage at an airport searched by passenger name, flight number, destination, etc.

I claim:

1. A system for assisting an operator in manually sorting mail, comprising:

a wireless headset including a microphone for translating a verbal statement from the operator into speech signals;

a speech recognition unit which recognizes addressee information corresponding to an item of mail from said speech signals;

a database which stores records corresponding to a plurality of addressees, each of said records including destination information for a respective one of said addressees;

a processing unit which searches the database for at least one record matching the addressee information recognized by said speech recognition unit; and an output unit which outputs results of said database search to the operator, wherein said output unit includes a heads-up display in said headset at a position viewable by the operator, said heads-up display outputting the results of said database search to the operator.

2. The system of claim 1, wherein said heads-up display displays information including said destination information in said at least one matching record.

3. The system of claim 1, wherein said output unit includes:

(i) a speech synthesis unit which converts electrical signals corresponding to results of said database search into speech signals; and (ii) at least one speaker included in said headset, said at least one speaker translating the speech signals corresponding to the results of said database search into audible signals understandable by the operator.

4. The system of claim 1, further comprising:

a printer which prints a label indicative of said destination information corresponding to the item of mail.

5. The system of claim 4, wherein said processing unit sends control signals to the printer instructing the printer to automatically print the label when said output unit outputs the results of said database search.

6. The system of claim 1, further comprising:

reporting means for tracking at least one of operator productivity and sorting volume statistics.

7. The system of claim 1, further comprising:

import means for importing a database of addressee information from a customer network.

8. The system of claim 1, wherein said wireless headset transmits said speech signals as RF signals.

9. The system of claim 1, wherein said speech recognition unit, said processing unit, and said output unit are included in a workstation remotely located from the operator wearing said wireless headset, said workstation including an RF receiver for receiving RF signals transmitted by said wireless headset.

10. The system of claim 9, wherein at least one wall separates said workstation from said wireless headset, and where the wireless headset transmits the RF signals through the wall.

11. The system of claim 10, wherein said workstation and the operator wearing said headset are located on different floors of a building.

12. The system of claim 1, wherein said processing unit communicates with said database through a network.

13. A system for assisting an operator in manually sorting mail, comprising:

a wireless headset including a microphone for translating a verbal statement from the operator into speech signals;

a speech recognition unit which recognizes addressee information corresponding to an item of mail from said speech signals;

a database which stores records corresponding to a plurality of addressees, each of said records including destination information for a respective one of said addressees;

a processing unit which searches the database for at least one record matching the addressee information recognized by said speech recognition unit; and an output unit which outputs results of said database search to the operator, said output unit including a display terminal which displays information including said destination information in said at least one matching record, wherein, when the processing unit finds a plurality of records matching the addressee information, the display terminal displays information indicative of the plurality of matching records, and wherein, when the speech recognition unit translates speech signals from the microphone indicative of a selection of one of said plurality of matching records, the display terminal displays further information including said destination information indicative of the selected matching record.

14. A system for assisting an operating in sorting mail, comprising:

a wireless headset including a microphone for translating a verbal statement from the operator into speech signals;

a speech recognition unit which recognizes addressee information corresponding to an item of mail from said speech signals;

a database which stores records corresponding to a plurality of addressees, each of said records including destination information for a respective one of said addressees;

a processing unit which searches the database for at least one record matching the addressee information recognized by said speech recognition unit; and an output unit which outputs results of said database search to the operator, wherein said output unit includes:

(i) a speech synthesis unit which converts electrical signals corresponding to results of said database search into speech signals, and (ii) at least one speaker included in said headset, said at least one speaker translating the speech signals corresponding to the results of said database search into audible signals understandable by the operator, and wherein said system further includes:

a keyboard for inputting an addressee name into said processing unit; and correct pronunciation means for receiving information indicative of an addressee name input by said keyboard and for instructing the speech synthesis unit to output speech signals to the headset speakers to inform the operator on how to phonetically pronounce the addressee name.

15. A method for sorting items of mail, comprising:

providing an operator with a wireless headset including a microphone;

translating a statement spoken into the microphone into speech signals;

transmitting the speech signals to a speech recognition unit;

recognizing addressee information corresponding to an item of mail from said speech signals;

searching a database of records corresponding to a plurality of addressees to find at least one record that matches said addressee information;

outputting information included within the at least one matching record; and manually sorting the item of mail based on destination information included in the at least one matching record, wherein said outputting step includes displaying information corresponding to the at least one matching record on a heads-up display included in the headset.

16. The method of claim 15, wherein said outputting step includes:

transmitting speech signals indicative of destination information corresponding to the at least one matching record to the headset;

outputting the destination information as audible synthesized speech through a speaker in the headset.

17. The method of claim 16, wherein if a plurality of records match said addressee information, said method includes:

sounding an alert to the operator through said headset speaker;

displaying information indicative of said plurality of matching records;

translating a second statement spoken in the microphone into selection signals, said second statement identifying a selection of one of said plurality of displayed matching records; and outputting information including destination information on at least one of a display and the headset speakers corresponding to said selected one of said plurality of matching records.

18. The method of claim 15, wherein said recognizing step is performed by at least one of speaker-independent and text-independent speech recognition.

19. The method of claim 15, further comprising:

translating instructions spoken in the microphone into additional speech signals, said instructions being of a type for controlling outputting of said information;

recognizing the instructions in said additional speech signals; and controlling outputting of information on said display terminal in accordance with said recognized instructions.

20. The method of claim 15, further comprising:

automatically printing a label indicative of said destination information corresponding to the item of mail when said output unit outputs the results of said searching step.

21. The method of claim 15, further comprising:

tracking at least one of operator productivity and sorting volume statistics; and generating a report based on said tracking step.

22. The method of claim 15, further comprising:

importing a database of addressee information from a customer network.

23. The method of claim 15, wherein said transmitting step includes transmitting the speech signals as RF signals to a speech recognition unit.

24. The method of claim 23, further comprising:

placing said speech recognition unit and said processing unit in a workstation remotely located from the operator.

25. The method of claim 24, further comprising:

placing the workstation at a location which is separated from the operator by at least one wall.

26. The method of claim 25, wherein said workstation and the operator are located on different floors of a building.

27. The method of claim 15, further comprising:

communicating between said processing unit and said database through a network.

28. A method for sorting items of mail, comprising:

providing an operator with a wireless headset including a microphone;

translating a statement spoken into the microphone into speech signals;

transmitting the speech signals to a speech recognition unit;

recognizing addressee information corresponding to an item of mail from said speech signals;

searching a database of records corresponding to a plurality of addressees to find at least one record that matches said addressee information;

outputting information included within the at least one matching record; and manually sorting the item of mail based on destination information included in the at least one matching record, wherein said outputting step includes displaying information corresponding to the at least one matching record on a display terminal, and wherein if a plurality of records matches said addressee information, said method further includes:

displaying information indicative of said plurality of matching records on said display terminal;

translating a second statement spoken in the microphone into selection signals, said second statement identifying a selection of one of said plurality of matching records; and outputting information including destination information corresponding to said selected one of said plurality of matching records.

29. A method for sorting items of mail, comprising:

providing an operator with a wireless headset including a microphone;

translating a statement spoken into the microphone into speech signals;

transmitting the speech signals to a speech recognition unit;

recognizing addressee information corresponding to an item of mail from said speech signals;

searching a database of records corresponding to a plurality of addressees to find at least one record that matches said addressee information, outputting information included within the at least one matching record; and manually sorting the item of mail based on destination information included in the at least one matching record, wherein said method further comprises:

inputting an addressee name into said processing unit using a keyboard; and outputting information indicative of a correct pronunciation of said addressee name.

* * * * *